US010737125B2

(12) United States Patent
Hirst et al.

(10) Patent No.: US 10,737,125 B2
(45) Date of Patent: Aug. 11, 2020

(54) FALL ARREST DEVICE

(71) Applicant: Capital Safety Group (Northern Europe) Limited, Bracknell, Berkshire (GB)

(72) Inventors: Robert Hirst, Stourbridge (GB); Steven Eltringham, Redditch (GB)

(73) Assignee: Capital Safety Group (Northern Europe) Limited, Berkshire (GB)

( * ) Notice: Subject to any disclaimer, the term of this patent is extended or adjusted under 35 U.S.C. 154(b) by 177 days.

(21) Appl. No.: 15/869,168

(22) Filed: Jan. 12, 2018

(65) Prior Publication Data

US 2018/0133525 A1 May 17, 2018

Related U.S. Application Data

(63) Continuation of application No. 14/768,955, filed as application No. PCT/EP2014/053033 on Feb. 17, 2014, now Pat. No. 9,884,211.

(30) Foreign Application Priority Data

Feb. 22, 2013 (GB) ..... 1303153.9

(51) Int. Cl.

| | |
|---|---|
| ***A62B 35/00*** | (2006.01) |
| ***A62B 35/04*** | (2006.01) |
| ***A62B 1/14*** | (2006.01) |

(52) U.S. Cl.

CPC ..... *A62B 35/0056* (2013.01); *A62B 1/14* (2013.01); *A62B 35/0062* (2013.01); *A62B 35/04* (2013.01)

(58) Field of Classification Search

CPC ..... A62B 35/0056; A62B 35/0062; A62B 35/0043; A62B 35/005; A62B 35/0068;

(Continued)

(56) References Cited

U.S. PATENT DOCUMENTS 4,083,512 A * 4/1978 Rumpf ..... B60R 22/405 242/383.4
4,177,962 A * 12/1979 Hildebrandt ..... B60R 22/38 242/383.5

(Continued)

FOREIGN PATENT DOCUMENTS

DE 202006002559 4/2006
DE 202012008377 3/2013

(Continued)

OTHER PUBLICATIONS

International Search Report issued in PCT/EP2014/053033, r pages.

(Continued)

*Primary Examiner* — Colleen M Chavchavadze

(57) ABSTRACT

A fall arrest device comprises a guide for a track member which, in use, passes through the device, a cam member including a cam portion, and a clutch responsive to at least one of the relative speed and relative acceleration of the fall arrest device and the track member. The clutch serves to determine when the relative speed and/or acceleration is at least a predetermined value. The clutch includes a trigger arm connecting to the cam member so as to move the cam portion of the cam member toward the guide so as to lock the track member between the cam member and the guide when at least the predetermined value is attained.

16 Claims, 3 Drawing Sheets

(58) Field of Classification Search
CPC ..... F16D 59/00; F16D 59/02; F16D 63/00; F16D 63/008
See application file for complete search history.

(56) References Cited

U.S. PATENT DOCUMENTS

| | | | | |
|---|---|---|---|---|
| 5,799,753 | A | 9/1998 | Peltier | |
| 7,281,620 | B2 * | 10/2007 | Wolner | A62B 1/10 192/223.1 |
| 8,056,676 | B2 | 11/2011 | Argoud | |
| 9,056,753 | B2 * | 6/2015 | Luntz | A62B 35/0093 |
| 9,121,462 | B2 * | 9/2015 | Casebolt | A62B 1/10 |
| 9,884,211 | B2 | 2/2018 | Hirst | |
| 2003/0029672 | A1 | 2/2003 | Argoud | |
| 2005/0039981 | A1 | 2/2005 | Wooster | |
| 2005/0051659 | A1 | 3/2005 | Wolner | |
| 2007/0119653 | A1 | 5/2007 | Brown | |
| 2007/0151805 | A1 | 7/2007 | Betcher | |
| 2008/0203210 | A1 * | 8/2008 | Nagata | B60R 22/4676 242/396.1 |
| 2009/0173578 | A1 | 7/2009 | Renton | |
| 2010/0032239 | A1 | 2/2010 | Rinklake | |
| 2011/0186382 | A1 | 8/2011 | Sudale | |
| 2016/0001100 | A1 | 1/2016 | Hirst | |

FOREIGN PATENT DOCUMENTS

| | | |
|---|---|---|
| EP | 1820539 | 8/2007 |
| EP | 2042217 | 4/2009 |
| WO | WO 2005/044383 | 5/2005 |
| WO | WO 2011/0050881 | 5/2011 |

OTHER PUBLICATIONS

Combiline, http://pdf.directindustry.com/pdf/vertic/combiline-life-line-system/41175-370206.html, relevant pages of a catalog retrieved from the internet on Mar. 3, 2017, pp. 1, 22-23, 48 (4 pages).

Combirail, http://pdf.directindustry.com/pdf/vertic/combirail/41175-171363.html, relevant pages of a catalog retrieved from the internet on Mar. 3, 2017, pp. 1, 28-29, 48 (4 pages).

* cited by examiner

FALL ARREST DEVICE

This application is a continuation application of U.S. patent application Ser. No. 14/768,955, filed Aug. 19, 2015, now U.S. Pat. No. 9,884,211, issued Feb. 6, 2018, which is a 371 of International Application No. PCT/EP2014/053033, filed Feb. 17, 2014, which claims priority to GB 1303153.9 filed Feb. 22, 2013, which are all incorporated by reference herein.

This invention relates to a fall arrest device.

According to the present invention there is provided a fall arrest device comprising: a guide for a track member which, in use, passes through the device; a cam member including a cam portion; and clutch means responsive to at least one of the relative speed and relative acceleration of the fall arrest device and the track member and adapted to determine when the relative speed and/or acceleration is at least a predetermined value, the clutch means including means connecting to the cam member so as to move the cam portion of the cam member toward the guide so as to lock the track member between the cam member and the guide when at least the predetermined value is attained.

The device may include two guides and cam members, the cam members being adapted and arranged to lock the track member against movement in either of two opposing directions. In such a case the clutch means may comprise a single bi-directional clutch means or a pair of clutch means responsive to movement in opposing directions.

The or each guide may be substantially triangular with the apex of the triangle innermost relative to the device.

The device may include a spring-biased retainer to retain the track member in position.

The device may include a back plate on which other components of the device are mounted. The or each cam member may be pivotably mounted on a pivot pin extending from the back plate. The cam member may be mounted on the pivot pin by way of a biasing assembly for biasing the cam member away from the track member. The pivot pin may be provided on that side of the retainer remote from the guide.

The or each cam member may include a re-set handle for re-setting the cam member to an inactive position after the device has been activated to lock the track member between the cam member and the guide.

The or each cam member may be protected by a cover plate. The cover plate may be movable to permit mounting and demounting the device relative to the track member.

The connecting means may comprise a trigger arm. The or each trigger arm may pass through the respective guide. The or each trigger arm may be profiled in the region of the cam member so as to engage with the cam member such that movement of the trigger arm in a first direction causes the cam member to rotate from its inactive position to its active position in which the track member is locked between the cam member and the guide.

When the cam member is in its active position in which the track member is locked between the cam member and the guide, but the device is stationary and not under load, the cam member may be re-set to its inactive position with a re-set handle forming part of the cam member.

The cam member may be internally profiled to engage with and re-set the trigger arm by moving the trigger arm in a second direction, opposite to the first direction.

The trigger arm may be formed with a recess which has an arcuate surface. The arcuate surface may align with an edge of an arcuate slot formed in the back plate. The cam member may be formed with a stop pin which engages in the arcuate slot provided in the back plate and also engages with the recess in the trigger arm.

Activation of the or each cam member may be effected by way of a clutch arrangement. The clutch arrangement may include a rotatable wheel adapted to engage with the track member as it passes through the device. The wheel may incorporate an elastomeric ring for engaging with the track member. The wheel or the ring may be profiled to enhance engagement with the track member. The clutch arrangement may include electronic or electromechanical means to determine the speed and/or acceleration of the fall arrest device relative to the track member, such as means for determining the rotational speed of the wheel, and electromechanical means, such as a solenoid, may be used to activate the or each cam member.

The clutch arrangement may comprise a centrifugal clutch assembly including a rotatable inertia device having an inertia reel positioned to at least one side of the wheel. An inertia reel may be positioned to each side of the wheel. The or each inertia device may be rotatable about an axis transverse to the axis of the track member. The or each inertia reel may rotate with the wheel.

The centrifugal clutch assembly may include at least one slip disc provided with means for engaging with the respective inertia reel when the relative speed and/or acceleration of the fall arrest device attains at least the predetermined value. The centrifugal clutch assembly may include two slip discs, each responsive to a different direction of movement of the track member relative to the fall arrest device. The engagement means may comprise a pin provided in a peripheral region of the slip disc and connected to the respective trigger arm.

The inertia reel may include at least one actuating member for engaging with the engagement means of the at least one slip disc. The actuating member may be pivotally mounted on the inertia reel. The or each actuating member may include an arcuate arm which is received in a corresponding arcuate recess formed in the inertia reel. A compression spring may be provided in the recess to urge the actuating member away from the recess and tending to rotate the actuating member such that a free end of the actuating member is urged radially inwardly. The free end of the actuating member may be formed with an engagement face which extends substantially in a radial direction for engaging with the engagement means of the respective slip disc.

For a better understanding of the present invention and to show more clearly how it may be carried into effect reference will now be made, by way of example, to the accompanying drawings in which.

Figure 1:
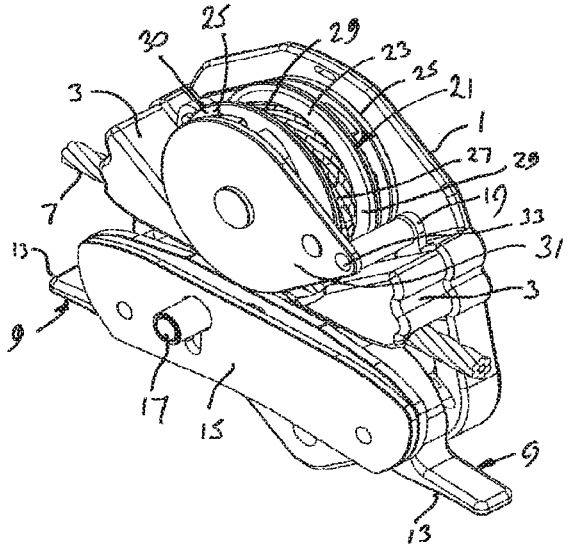
FIG. 1 is a perspective view of one embodiment of a fall arrest device according to the present invention.
Figure 2:
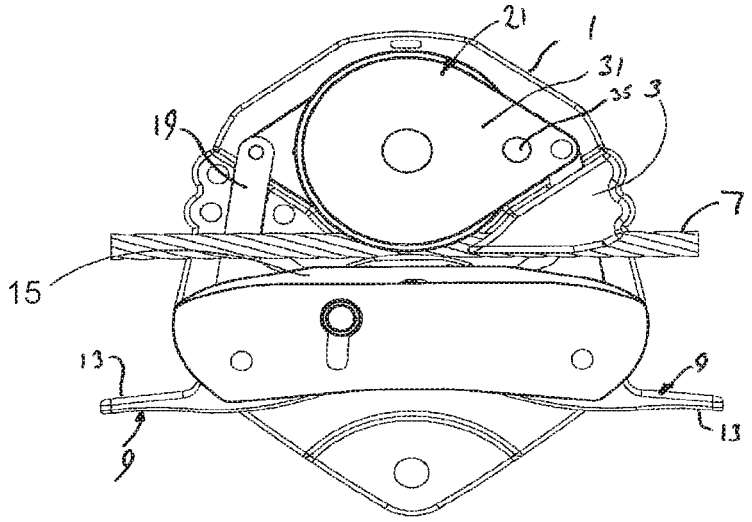
FIG. 2 is a front elevational view of the fall arrest device shown in FIG. 1.

The fall arrest device which forms part of a lifeline system is shown in the figures and comprises a back plate 1 to which is attached a pair of cable guides 3 which are generally triangular and narrow from the edges of the back plate 1 towards a centre region thereof (that is, the apex of the triangle is innermost relative to the device), the adjacent tapered ends of the cable guides being spaced from each other (it should be noted the left-hand cable guide has been removed in FIG. 2 in order to show other features of the device). A spring-biased retaining block 5 is urged towards a track member in the form of a cable 7, forming another part of the lifeline system, to retain the cable between the retaining block and the cable guides 3. The cable 7 may be arranged in use at any angle between 0 and 90 degrees to the horizontal. Although a metal cable is illustrated, other commonly used forms of cable or the like may be provided, including rope, webbing and solid or inflexible materials such a metal bar.

Figure 3:
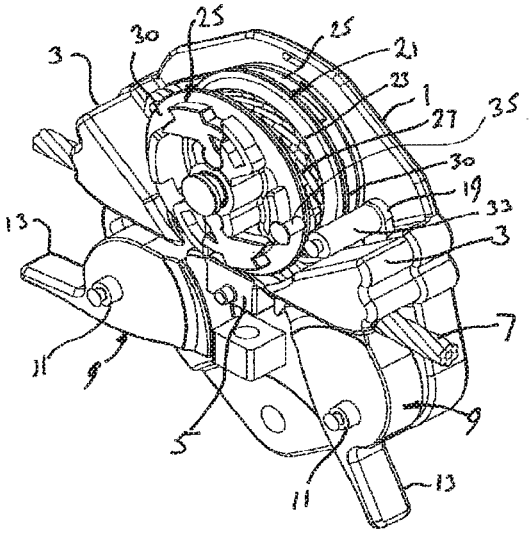
FIG. 3 is a perspective view of the fall arrest device with a number of components removed.
Figure 4:
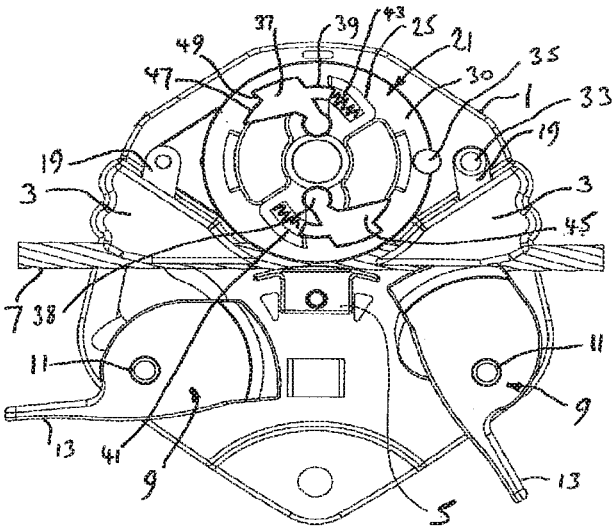
FIG. 4 is a front elevational view of the fall arrest device shown in FIG. 3.

A pair of rotatable cam members 9 are pivotably mounted on a pivot pin 11 extending from the back plate 1 on that side of the retaining block remote from the cable guides with a cam portion of one cam member substantially opposite a respective cable guide so as to grip against the cable when actuated and to urge the cable against the adjacent cable guide so as to give rise to a braking effect. A re-set handle 13 is provided for re-setting the cam members 9 to an inactive position after the device has been activated. FIGS. 3 and 4 show a left-hand cam member in an inactive position and a right-hand cam member in an active position in which it is braking movement of the cable from the left to the right as shown in FIGS. 3 and 4. That is the cam members 9 are in a configuration in the inactive position in which the re-set handle extends generally parallel to the cable 7, and the cam members 9 are in a configuration in the active position in which the re-set handle extends generally transverse to the cable 7.

In use of the device, the retaining block 5 and the cam members 9 are protected by a cover plate 15 which is fixed relative to the remainder of the device, but which shields an inner plate that is movable by way of a release button 17 to allow the device to be mounted and demounted relative to the cable 7. While the device is removable from the cable 7, the device as illustrated works in both directions and orientation is therefore unimportant for this embodiment of the present invention.

A trigger arm 19 (which also acts as a re-set arm) is arranged between each of the cam members 9 and the back plate 1 and is connected to a triggering mechanism which will be explained in detail hereinafter. Each trigger arm 19 passes through the respective cable guide 3. The trigger arm 19 is profiled in the region of the cam member 9 and engages with the cam member such that movement of the trigger arm in a direction away (i.e., upwardly as shown in the figures) from the pivot pin 11 of the cam member 9 causes the cam member to rotate from its inactive position to its active position when the device is moving at least at a predetermined speed and/or acceleration relative to the cable. That is, the right-hand cam member is moved to its active position when the cable is moving to the right relative to the device at least at a predetermined speed and/or acceleration relative to the device and the left-hand cam member is moved to its active position when the cable is moving to the left relative to the device at least at a predetermined speed and/or acceleration relative to the device.

When the cam member is in its active position, but the device is stationary and not under load, the cam member can be re-set to its inactive position with the re-set handle 13. The cam member is internally profiled to engage with and re-set the trigger arm 19 by moving the trigger arm in a direction towards (i.e., downwardly as shown in the figures) towards the pivot pin 11 of the cam member.

Figure 5:
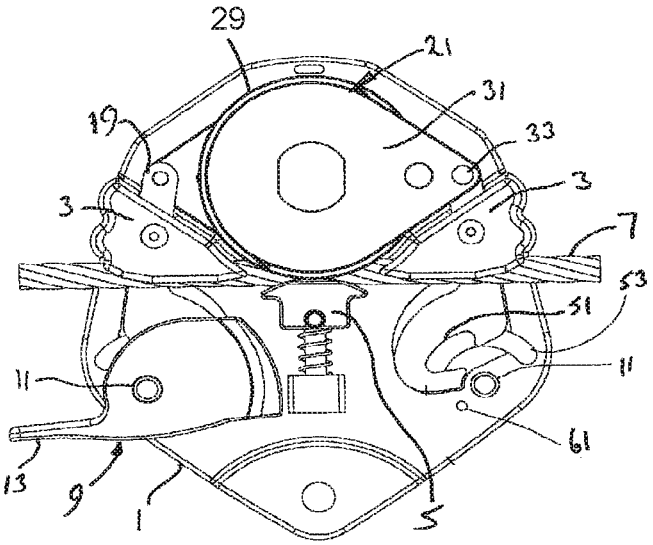
FIG. 5 is a front elevational view corresponding to FIG. 4, but with further components, including a cam member, removed.
Figure 6:
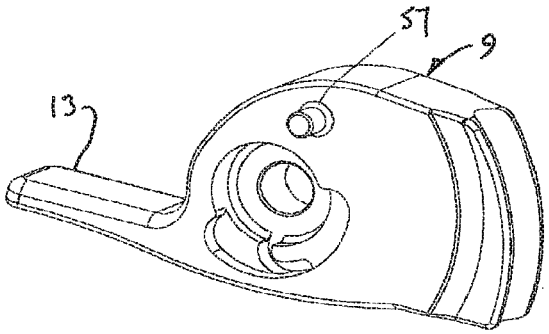
FIG. 6 is a perspective view of the cam member removed from FIG. 5.
Figure 7:
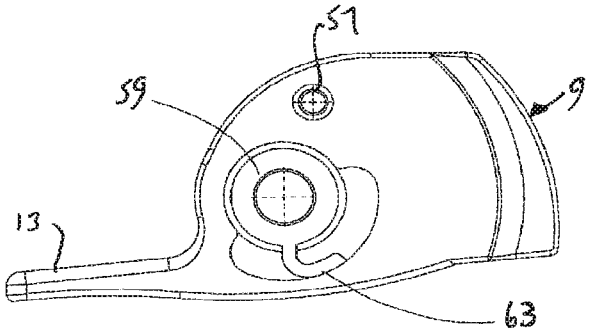
FIG. 7 is an elevational view of the cam member shown in FIG. 6.

FIG. 5 shows the fall arrest with one of the cam members 9 (the right hand cam member) removed. The cam member itself is shown in FIGS. 6 and 7. As can be seen from FIG. 5, the trigger arm 19 is formed with a recess 51 which has an arcuate surface, the arcuate surface aligning with an edge of an arcuate slot 53 formed in the back plate 1. The recess 51 effectively forms a hook at each end of the arcuate slot. The cam member 9 is mounted on the back plate 1 by way of pivot pin 11 which engages in a corresponding bore provided in the cam member 9. The cam member is also formed with a stop pin 57 which engages in the arcuate slot 53 provided in the back plate and also engages with the recess 51 in the trigger arm 19. The cam member 9 is mounted on the pivot pin 11 by way of a biasing assembly 59 which includes a spring retention pin 61 protruding from the back plate 1 and a torsion spring (not shown) which terminates in a spring retention profile 63 for biasing the cam member 9 to its disengaged configuration.

Activation of the cam members 9 is controlled by a rotatable inertia device 21 (or centrifugal clutch assembly) which is in the form of a central wheel 23 with an inertia reel 25 positioned to each side of the central wheel. The spring-biased retaining block 5 also helps to ensure the central wheel 23 rotates with relative movement between the fall arrest device and the cable 7. The inertia device is rotatable about an axis transverse to the axis of the cable 7. The central wheel 23 has an elastomeric insert 27 between two circular side walls 29, the insert having a smaller diameter than the side walls so as to accommodate a part of the cross-sectional area of the cable 7 where the cable passes over the retaining block 5. The insert 27 may be formed with angled grooves adapted to engage with corresponding strands of the cable so as to increase friction, and therefore grip, between the cable and the wheel.

The central wheel 23 rotates as the cable 7 passes between the wheel and the retaining block 5. The inertia reels 25 rotate with the central wheel. A slip disc 30 forms part of the centrifugal clutch and is positioned between the side walls 29 of the central wheel 23 and the inertia reel 25. Each slip disc 30 is attached to a different one of the trigger arms 19 by way of a cover 31 for the respective inertia reel. That is, the cover is generally circular, but is provided with an extending portion which is pivotally connected to a pin 33 forming part of the trigger arm 19. A further pin 35 is provided in the peripheral region of the respective slip disc 30 and extends between the slip disc and the respective cover 31. The inertia reel 25 is therefore positioned between the slip disc 30 and the cover 31.

Each inertia reel 25 also includes a pair of actuating members 37 (or pawls) which are positioned diametrically opposite the axis of rotation of the inertia device. In practice, the number of actuating members is not important and may be fewer than two (i.e., a single actuating member may be provided) or may be greater than two. The actuating members are pivotally mounted on the inertia reel and pivot about an axis 38 parallel to the axis of rotation of the inertia device. Each actuating member 37 includes an arcuate arm 39 which is received in a corresponding arcuate recess 41 formed in the inertia reel 25. A compression spring 43 is provided in the recess and urges the actuating member 37 away from the recess tending to rotate the actuating member such that a free end 45 of the actuating member is urged radially inwardly. The free end 45 of the actuating member 37 is profiled with a landing area 47 which extends substantially in a circumferential direction and an engagement face 49 which extends substantially in a radial direction. As the inertia device rotates in an anti-clockwise direction as shown in FIGS. 4 and 5, the mass of the free end 45 of the actuating member causes the actuating member to pivot about the axis 38 such that the arcuate arm 39 compresses the spring 43 and the free end 45 moves radially outwardly as a result of centrifugal force. When the inertia device rotates at a predetermined speed the free end 45 will have moved radially outwardly a sufficient distance for the engagement face 49 to engage with the further pin 35.

The number of inertia reels 25 is also optional in that a single inertia wheel may be provided. In such a case, either the fall arrest device may only operate in a single direction, or the actuating member(s) may be constructed to move outwardly irrespective of the direction of rotation of the inertia device. Moreover, separate inertia wheels may be provided for each direction if desired.

Once the device activates it locks onto the cable 7 and prevents relative movement between the cable and the device until the device is released.

Each inertia reel 25 works in the opposite direction to the other in order to control relative movement of the cable 7 in either direction. That is, the outer inertia reel operates if the cable is moving at more than a predetermined speed and/or acceleration to the right as shown in the figures (or the device is moving at more than a predetermined speed and/or acceleration to the left) and the inner inertia reel operates if the cable is moving at more than a predetermined speed and/or acceleration to the left as shown in the figures (or the device is moving at more than a predetermined speed and/or acceleration to the right).

Other forms of clutch arrangement may be used, having the same effect as a centrifugal clutch. For example, electronic or electromechanical means may be provided to determine the speed and/or acceleration of the fall arrest device relative to the cable 7, such as means for determining the rotational speed of the central wheel 23, and electromechanical means, such as a solenoid, may be used to activate the cam member(s) 9. Electrical power for such devices may be provided, for example by batteries and/or by generating power as a result of relative movement between the fall arrest device and the cable and/or by using the cable 7 as an electrical conductor and/or by providing a separate electrically-conducting cable. Such an electromechanical clutch arrangement would permit the fall arrest device to be more compact and would allow greater flexibility in the relative arrangement of the components of the device.

The invention claimed is:

1. A fall arrest device comprising:

a guide for a track member which, in use, passes through the device;

a cam member including a cam portion, the cam member pivotally mounted for rotation about a cam member axis; and a centrifugal clutch assembly responsive to at least one of a relative speed and relative acceleration of the fall arrest device and the track member and adapted to determine when the relative speed and/or acceleration is at least a predetermined value, wherein the centrifugal clutch assembly comprises:

a rotatable wheel adapted to engage with the track member as it passes through the device; and a rotatable inertia device having at least one inertia reel positioned on one of a first side and a second side of the rotatable wheel, wherein the inertia device is rotatable about an inertia device axis transverse to an axis of the track member, and wherein the at least one inertia reel rotates with the wheel;

wherein the centrifugal clutch assembly is operatively connected to the cam member to move the cam portion of the cam member toward the guide when the predetermined value is attained, and wherein the cam member axis is offset from the inertia device axis.

2. The fall arrest device of claim 1, wherein the at least one inertia reel comprises:

a first inertia reel positioned on the first side of the rotatable wheel; and a second inertia reel positioned on the second side of the rotatable wheel.

3. The fall arrest device of claim 1, wherein the centrifugal clutch assembly includes at least one slip disc provided with a pin configured and arranged to engage the at least one inertia reel when the relative speed and/or acceleration of the fall arrest device attains at least the predetermined value.

4. The fall arrest device of claim 3, wherein the at least one slip disc comprises two slip discs, wherein each slip disc is responsive to a different direction of movement of the track member relative to the fall arrest device.

5. The fall arrest device of claim 3, wherein the at least one inertia reel comprises at least one actuating member for engaging with the pin of the at least one slip disc.

6. The fall arrest device of claim 5, wherein the at least one actuating member is pivotally mounted on the at least one inertia reel, wherein the at least one actuating member comprises an arcuate arm received in a corresponding arcuate recess formed in the at least one inertia reel.

7. The fall arrest device of claim 6, wherein a compression spring is provided in the arcuate recess to urge the at least one actuating member away from the recess to rotate the at least one actuating member such that a free end of the at least one actuating member is urged radially inwardly.

8. The fall arrest device of claim 7, wherein the free end of the at least one actuating member is formed with an engagement face that extends substantially in a radial direction for engaging with the pin of the respective slip disc.

9. The fall arrest device of claim 1, further comprising a trigger arm connected to the cam member to move the cam portion of the cam member toward the guide so as to lock the track member between the cam member and the guide when at least the predetermined value is attained.

10. The fall arrest device of claim 1, wherein the rotatable wheel further comprises an elastomeric ring for engaging with the track member.

11. The fall arrest device of claim 1, wherein the rotatable inertia device comprises a bi-directional inertia device.

12. The fall arrest device of claim 1, wherein the centrifugal clutch assembly is connected to the cam member with a trigger arm.

13. A fall arrest device comprising:

a guide for a track member which, in use, passes through the device;

a cam member including a cam portion; and a centrifugal clutch assembly responsive to at least one of a relative speed and relative acceleration of the fall arrest device and the track member and adapted to determine when the relative speed and/or acceleration is at least a predetermined value, wherein the centrifugal clutch assembly comprises:

a rotatable wheel adapted to engage with the track member as it passes through the device;

a rotatable inertia device having at least one inertia reel positioned on one of a first side and a second side of the rotatable wheel, wherein the inertia device is rotatable about an axis transverse to an axis of the track member, and wherein the at least one inertia reel rotates with the wheel;

wherein the centrifugal clutch assembly is operatively connected to the cam member to move the cam portion of the cam member toward the guide when the predetermined value is attained, and wherein the cam member includes a re-set handle for re-setting the cam member to an inactive position after the device has been activated to lock the track member between the cam member and the guide.

14. A fall arrest device comprising:

a guide for a track member which, in use, passes through the device;

a cam member including a cam portion; and a centrifugal clutch assembly responsive to at least one of a relative speed and relative acceleration of the fall arrest device and the track member and adapted to determine when the relative speed and/or acceleration is at least a predetermined value, wherein the centrifugal clutch assembly comprises:

a rotatable wheel adapted to engage with the track member as it passes through the device;

a rotatable inertia device having at least one inertia reel positioned on one of a first side and a second side of the rotatable wheel, wherein the inertia device is rotatable about an axis transverse to an axis of the track member, and wherein the at least one inertia reel rotates with the wheel;

wherein the centrifugal clutch assembly is operatively connected to the cam member to move the cam portion of the cam member toward the guide when the predetermined value is attained, and wherein the centrifugal clutch assembly further comprises a solenoid adapted to determine the relative speed and/or acceleration of the fall arrest device relative to the track member.

15. The fall arrest device of claim 14, wherein the solenoid is further adapted to determine a rotational speed of the wheel.

16. The fall arrest device of claim 14, wherein the solenoid is adapted to activate the cam member.

* * * * *